US005201449A

United States Patent [19]

Miller

[11] Patent Number: 5,201,449

[45] Date of Patent: Apr. 13, 1993

[54] PNEUMATICALLY POWERED OR COMBUSTION-POWERED FASTENER-DRIVING TOOL USEFUL WITH BRICK-FACED SIDING

[75] Inventor: Charles D. Miller, Mundelein, Ill.

[73] Assignee: Illinois Tool Works Inc., Glenview, Ill.

[21] Appl. No.: 905,460

[22] Filed: Jun. 29, 1992

[51] Int. Cl.[5] ..... B25C 1/04

[52] U.S. Cl. ..... 227/8; 227/110

[58] Field of Search ..... 227/8, 66, 110

[56] References Cited

U.S. PATENT DOCUMENTS

| | | | |
|---|---|---|---|
| 2,925,603 | 2/1960 | Pfaff et al. | 227/8 |
| 2,966,683 | 1/1961 | Schulz | 227/8 |
| 4,196,833 | 4/1980 | Haytayan | 227/8 |
| 4,483,474 | 11/1984 | Nikolich | 227/8 |
| 4,821,937 | 4/1989 | Rafferty | 227/8 |
| 5,025,968 | 6/1991 | Nasiatka | 227/8 |

*Primary Examiner*—Douglas D. Watts
*Assistant Examiner*—Scott A. Smith
*Attorney, Agent, or Firm*—Schwartz & Weinrieb

[57] ABSTRACT

A pneumatically powered or combustion-powered fastener-driving tool for driving a fastener having a head into a gap between two brick faces affixed to a backing board in a siding panel. A workpiece-contacting element is adapted to contact the raised surfaces and is biased toward an extended position. A probe extending into the gap when the workpiece-contacting element contacts the brick faces and is moved into a retracted position is joined to such element so as to be conjointly movable therewith. A nosepiece, which guides the fastener as it is driven, is configured to extend into the gap, beyond the workpiece-contacting element when such element is moved into the retracted position.

5 Claims, 2 Drawing Sheets

PNEUMATICALLY POWERED OR COMBUSTION-POWERED FASTENER-DRIVING TOOL USEFUL WITH BRICK-FACED SIDING

TECHNICAL FIELD OF THE INVENTION

This invention pertains to a fastener-driving tool, which may be pneumatically powered or combustion-powered, and which is useful with a siding panel of a type having brick faces affixed to a backing board and spaced so as to define gaps between the brick faces. The fastener-driving tool is useful for driving a fastener having a head, such as a siding or roofing nail, into a selected gap between two brick faces, so that the head bears against the backing board. The tool can also drive staples into the gap.

BACKGROUND OF THE INVENTION

Siding panels of the type noted above are used widely in residential, commercial, and other building construction, both exteriorly and interiorly. Usually, each brick face conforms generally to a rectangular solid. Exemplary dimensions for each brick face in a common orientation are a vertical width of approximately 2.25 inches, a horizontal length of approximately 7.5 inches, and a thickness of approximately 0.5 inch. The backing board may be made from high density, nail base, asphalt-impregnated fiberboard, to which each brick face is affixed by an exterior, waterproof, synthetic rubber-base adhesive. Exemplary dimensions for such a backing board are a width of approximately 16.4 inches, a length of approximately 48 inches, and a thickness of approximately 0.5 inch. Each gap between two brick faces may have a width of approximately 0.325 high and a depth of approximately 0.5 inch.

Commonly, such a siding panel is fastened to studs, block or brick walls, or other substrates by conventional siding or roofing nails having heads. Staples may be alternatively used. If such nails are used, it is common for such nails to be hand-driven via a hammer to depths assuring that the hammer does not strike the brick faces and then to be hand-set via a hammer and a nail-setting tool, until the heads of such nails are disposed against the backing board. Such hand-driving and hand-setting steps tend to be highly inefficient.

Typically, as known heretofore, pneumatically powered and combustion-powered fastener-driving tools are not suitable for driving such nails or staples into the narrow gaps, between the brick faces, against the backing board. Typically, such a tool comprises a nosepiece for guiding a fastener as the fastener is driven and a workpiece-engaging element, which is biased toward an extended position, and which disables the tool unless such element is moved to a retracted position. As known heretofore, the nosepiece and the workpiece-engaging element form an assembly that is designed to coact with flat surfaces, and that does not fit into such a gap.

There has been a need, to which this invention is addressed, for a pneumatically powered or combustion-powered fastener-driving tool that can be effectively used with siding material of the type noted above.

SUMMARY OF THE INVENTION

This invention provides an improved fastener-driving tool, which may be pneumatically powered or combustion-powered, for driving a fastener into a gap between two raised surfaces of a workpiece, such as a gap between two brick faces affixed to a backing boarding a siding panel of the type noted above. Broadly, the improved tool comprises a workpiece-contacting element and a nosepiece in a novel arrangement enabling the nosepiece to extend into the gap, beyond the raised surfaces.

The workpiece-contacting element, which is adapted to contact at least one of the raised surfaces, is movable between an extended and a retracted position and is biased toward the extended position. The nosepiece, which is adapted to guide such a fastener being driven by the tool, is configured to extend into the gap, beyond the workpiece-contacting element, at least when such element contacts the raised surface and is moved into the retracted position.

In one contemplated embodiment, a probe is adapted to extend into the gap, beyond the workpiece-contacting element, when such element contacts the raised surfaces. Preferably, the probe and the workpiece-contacting element are joined so as to be conjointly movable. Preferably, moreover, the workpiece-contacting element includes a pair of workpiece-contacting regions spaced from each other, on opposite sides of the probe. Each workpiece-contacting region is adapted to contact a respective one of the raised surfaces.

Desirably, the nosepiece is configured so as to extend slightly beyond said element when said element is moved into the extended position, and so as to extend further beyond such element when such element is moved into the retracted position.

BRIEF DESCRIPTION OF THE DRAWINGS

These and other objects, features, and advantages of this invention will be evident from the following description of two alternate embodiments of this invention and with reference to the accompanying drawings, in which like reference characters designate like or corresponding parts throughout the several views, and wherein.

DETAILED DESCRIPTION OF ILLUSTRATED EMBODIMENTS

Figure 1:
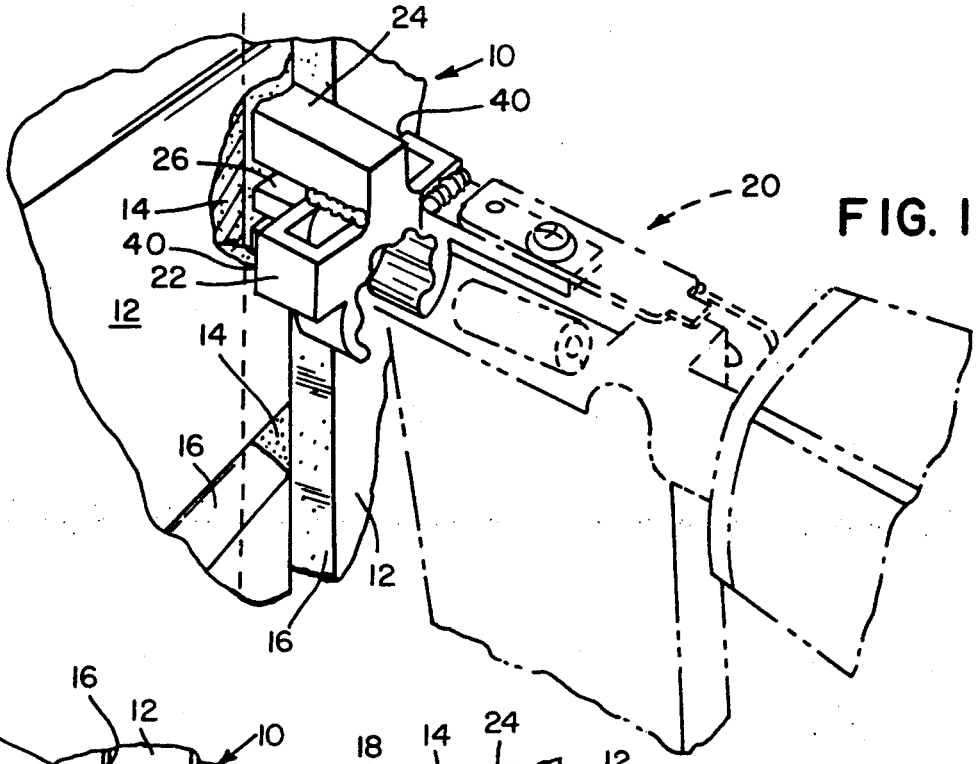
FIG. 1 is a fragmentary, perspective view of a fastener-driving tool constituting a preferred embodiment of this invention, as used to drive fasteners into gaps between brick faces affixed to a backing panel.
Figure 2:
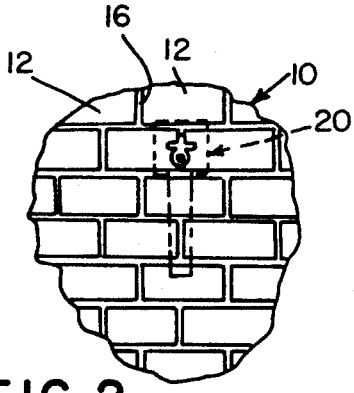
FIG. 2, on a greatly reduced scale, is a fragmentary, elevational view of the backing panel and the brick faces. The fastener driving tool is shown in broken lines.
Figure 3:
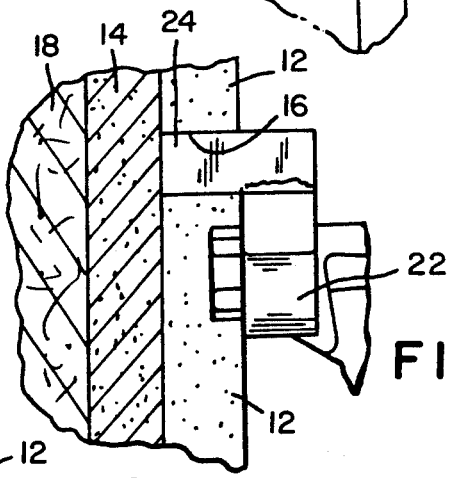
FIG. 3, is a fragmentary elevational view of certain elements of the fastener-driving tool, as shown in FIG. 1. The backing panel and brick face are shown fragmentarily and partly in cross-section. A siding nail having a large head is shown as being driven in fully lines and as having been driven in broken lines.

As shown in FIGS. 1, 2 and 3, a siding panel 10 comprising brick faces 12 affixed to a backing board 14 so as to define similar gaps 16 between such faces 12 is being fastened to a substrate 18 (see FIG. 3) by a fastener-driving tool 20. The tool 20 comprises a workpiece-contacting element 22, a probe 24 welded to such element 22, and a nosepiece 26, through which a driving blade 28 is operable, in a novel combination according to a first embodiment of this invention. Because of the novel combination, the tool 20 can be effectively used for driving a fastener having a head, such as a siding nail, into a selected gap 16 between two brick faces 12.

Each brick face 12 conforms generally to a rectangular solid. Exemplary dimensions for each brick face 12, as shown, are a vertical width of approximately 2.25 inches, a horizontal length of approximately 7.5 inches, and a thickness of approximately 0.5 inch. The backing board 14 may be made from high density, nail base, asphalt-impregnated fiberboard, to which each brick face 12 is affixed by an exterior, waterproof, synthetic rubber-base adhesive. Exemplary dimensions for the backing board 14 are a width of approximately 16.5 inches, a length of approximately 48 inches, and a thickness of approximately 0.5 inch. Each gap 16 between two brick faces 12 may have a width of approximately 0.305 inch and a depth of approximately 0.5 inch. Such siding structures are available commercially from Panel Brick Mfg., Inc. of Owensboro, Ky., under the trade designation of Brickette® panels.

As shown in FIGS. 1 through 6, the fastener-driving tool 20 may be a pneumatically powered fastener-driving tool, which is similar (except for the novel combination noted above) to pneumatically powered fastener-driving tools available commercially from ITW Paslode (a unit of Illinois Tool Works Inc.) of Lincolnshire, Ill., under its PASLODE® trademark.

Figure 4:
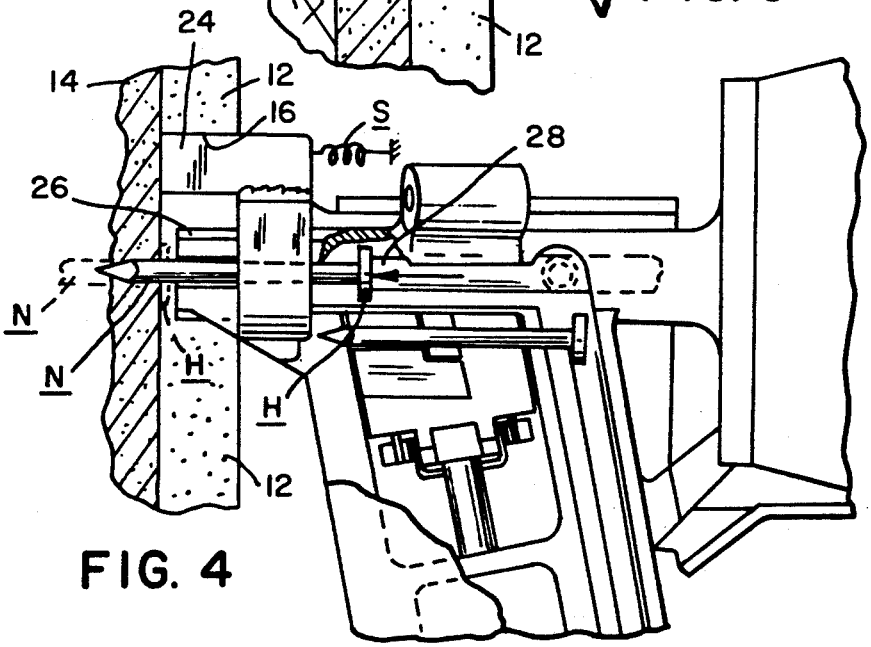
FIG. 4 is a fragmentary, partly elevational, partly cross-sectional view of the same and additional elements of the fastener-driving tool, as used to drive a siding nail into the gap between two brick faces. The backing panel and one brick face are shown fragmentarily and partly in cross-section.
Figure 5:
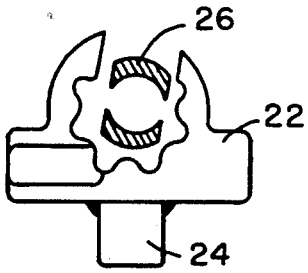
FIG. 5 and 6 respectively are elevational views of the workpiece-contacting element and the probe, as seen from different vantages, with the nosepiece being shown in cross-section in FIG. 5.

Except as illustrated and described herein, the workpiece-contacting element 22 is similar to the workpiece-contacting elements of such commercially available tools in being movable between an extended position (in which it is shown in FIG. 3) and a retracted position (in which it is shown in FIG. 4) and in being biased by a spring or springs S (one shown diagrammatically) toward the extended position. Furthermore, the workpiece-contacting element 22 is similar thereto in being arranged with other, known elements of the tool 20 to disable the tool 20 except when such element 22 is moved to the retracted position (as by being pressed firmly against a workpiece) and to enable the tool 20 to be manually actuated via a trigger (not shown) so as to drive a fastener, such as a siding nail N having a large head H, when such element 22 is moved to the retracted position.

Figure 9:
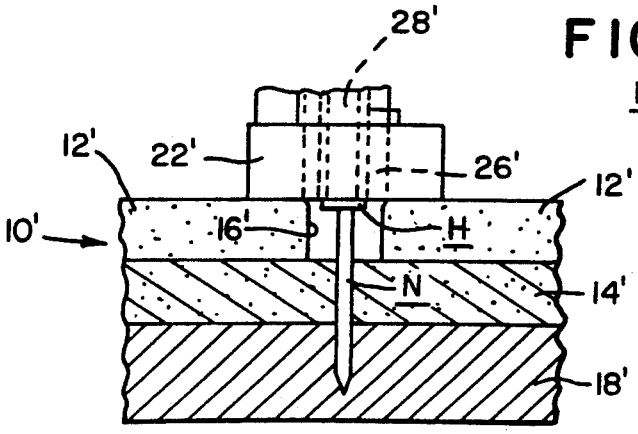
FIG. 9 PRIOR ART
FIG. 9, which exemplifies prior art, is a fragmentary, partially sectioned view of a similar siding member being fastened to a substrate by a fastener driving tool comprising a known combination of a workpiece-contacting element and a nosepiece.

As shown in FIG. 9, which exemplifies prior art, it is common in a fastener-driving tool for a workpiece-contacting element 22' and a nosepiece 26', through which a driving blade 28' is operable, to be so arranged that the workpiece-contacting element 22' is biased by a spring or springs (not shown) toward an extended position and that it is necessary to move such element 22' to a retracted position (in which it is shown) before the tool can be manually actuated via a trigger (not shown) so as to drive a fastener, such as a siding nail N having a large head H. Moreover, as shown, it is common for the workpiece-contacting element 22', the nosepiece 26', and the driving blade 28' to be so arranged that the nosepiece 26' does not extend beyond the workpiece-contacting element 22' when such element 22' is moved to the retracted position and that the driving blade 28' does not extend beyond the nosepiece 26' when a fastener is being driven.

In FIG. 9, a workpiece is shown, which is a siding panel 10' similar to the siding panel 10, along with a substrate 18'. The siding panel 10' comprises brick faces 12' affixed to a backing board 14' so as to define similar gaps 16' (one shown) between such faces 12'. Because the workpiece-contacting element 22' bridges two brick faces 12' having a gap 16' therebetween, as shown, the nail N can be thus driven only so far as to place its head H at a level with the brick faces 12'. The nail N must be manually set for its head H to enter the gap 16', between the brick face 12', and to bear against the backing board 14'.

However, the novel arrangement shown in FIGS. 1 through 6 is different. As shown therein, the workpiece-contacting element 22 has two workpiece-contacting regions 40, on opposite sides of the probe 24. Also, each workpiece-contacting region 40 is adapted to contact a respective one of the brick faces 12, on opposite sides of a gap 16. Being welded to the workpiece-contacting element 22 so as to be conjointly movable with such element 22, the probe 24 extends beyond such element 22 and is adapted to extend into the gap 16 when such element 22 contacts the brick faces 12, on opposite sides of the gap 16.

As shown in FIG. 4, the nosepiece 26 is configured so as to extend into the gap 16, beyond the workpiece-contacting element 22, at least when such element 22 is moved into the retracted position. Preferably, as shown, the nosepiece 26 is configured so as to extend slightly beyond such element 22 when such element 22 is moved into the extended position, and so as to extend further beyond such element 22 when such element 22 is moved into the retracted position.

Thus, as shown in broken lines in FIG. 4, when it is driven by the tool 20, a siding nail N is driven into the gap 16, between the brick faces 12, until its head H bears against the backing board 14. The probe 24 helps to position the tool 20 so that the nail head H can pass into the gap 16, between the brick faces 12, without a risk of damage to the brick faces 12.

Figure 7:
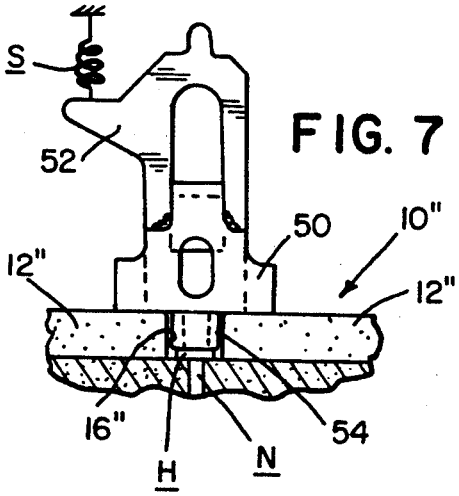
FIG. 7 is a fragmentary view of a workpiece-contacting element, a link having such element welded thereto, and a nosepiece in a novel combination according to a second embodiment of this invention.
Figure 6:
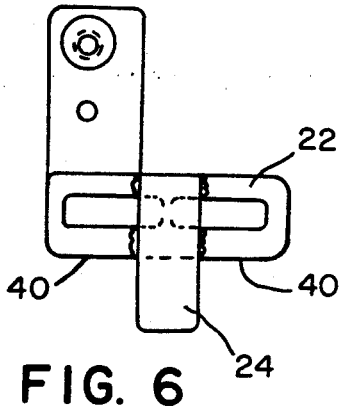
Figure 8:
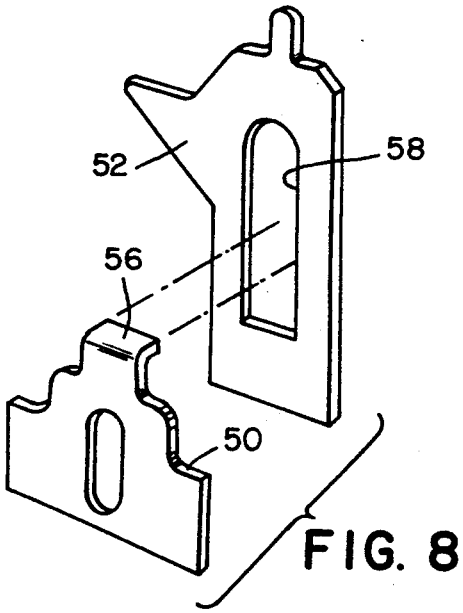
FIG. 8 is an exploded, perspective view of the workpiece-contacting element and the link, in the novel combination shown in FIG. 7.

As shown in FIGS. 7 and 8, a workpiece-contacting element 50, a link 52, and a nosepiece 54, as elements of a fastener-driving tool, define a novel combination according to a second embodiment of this invention. Broadly, the second embodiment is similar to the first embodiment except that the second embodiment does not comprise a probe similar to the probe 24 of the first embodiment. Also, a siding panel 10" is shown, which is similar to the siding panel 10. The siding panel 10" comprises brick faces 12" affixed to a backing panel 12" so as to define similar gaps 16" (one shown) between such faces 12".

The fastener-driving tool noted in the preceding paragraph may be a combustion-powered fastener-driving tool similar (except for the novel combination noted therein) to combustion-powered fastener-driving tools available commercially from ITW Paslode (a unit of Illinois Tool Works Inc.) of Lincolnshire, Ill., under its IMPULSE ® trademark.

As shown in FIG. 7, the workpiece-contacting element 50 has a sufficient width to contact the brick faces 12'' on opposite sides of such a gap 16'', at spaced workpiece-contacting regions on such element 50. Also, such element 50 has a tab 56, which extends into a slot 58 in the link 52 so as to permit such element 50 to be adjustably positioned along the link 52 before such element is welded to the link 52, on opposite sides of the slot 58.

The workpiece-contacting element 50 is similar to the workpiece-contacting element 22 of the first embodiment in being movable with the link 52 between an extended position (in which it is shown in FIG. 7) and a retracted position and in being biased with the link 52 by a spring or springs S (one shown diagrammatically) toward the extended position. Moreover, the workpiece-contacting element 50 is similar thereto in being arranged with the link 52 and with other, known elements of the tool to disable the tool except when such element 50 is moved to the retracted position (as by being pressed firmly against two brick faces 12'') and to enable the tool to be manually actuated via a trigger (not shown) so as to drive a fastener, such as a siding nail N having a large head H, when such element 50 is moved to the retracted position.

Furthermore, the nosepiece 54 is configured so as to extend into the gap 16'', beyond the workpiece-contacting element 50, at least when such element 50 is moved into the retracted position. Preferably, as in the first embodiment, the nosepiece 54 is configured so as to extend slightly beyond such element 50 when such element 50 is moved into the extended position, and so as to extend further beyond such element 50 when such element 50 is moved into the retracted position.

Various modifications may be made in the preferred embodiment described above without departing from the scope and spirit of this invention.

I claim:

1. A powered fastener-driving tool for driving a fastener into a gap located between two raised surfaces of a workpiece, such as a gap having a predetermined width and defined between two brick faces affixed to a backing board of a siding panel, comprising:

a workpiece-contacting element, having a pair of oppositely extending workpiece-contacting regions disposed along a first axis upon opposite sides of said gap for contacting said raised surfaces of said workpiece, movable between an extended position and a retracted position, and biased toward said extended position;

a nosepiece extending beyond said workpiece-contacting element and into said gap, at least when said workpiece-contacting regions of said workpiece-contacting element contact said raised surfaces of said workpiece and said workpiece contacting element is moved to said retracted position, for guiding said fastener, driven by said tool, into said gap of said workpiece, said nosepiece having a second axis disposed perpendicularly to said first axis of said workpiece-contacting element; and a probe fixed to said workpiece-contacting element and having a third axis laterally offset from but disposed parallel to said second axis of said nosepiece, said probe extending forwardly of said workpiece-contacting element and comprising parallel side portions spaced apart a distance which is substantially equal to said predetermined width of said gap defined between said two brick faces so as to be able to be disposed within said gap when said workpiece-contacting regions of said workpiece-contacting element contact said respective ones of said raised surfaces and thereby facilitate location of said nosepiece within said gap whereby said fastener, driven by said tool, can be properly driven into said gap defined between said two raised surfaces of said workpiece and into a substrate upon which said siding panel is to be affixed.

2. The powered fastener-driving tool of claim 1 wherein the nosepiece is configured so as to extend slightly beyond said element when said element is moved into the extended position, and so as to extend further beyond said element when said element is moved into the retracted position.

3. A tool as set forth in claim 1, wherein:

said probe, said nosepiece, and said workpiece-contacting element, as defined by said first, second, and third axes thereof, defined a cross-sectional configuration for said tool which is that of a plus (+) sign.

4. A tool as set forth in claim 1, further comprising:

spring means for biasing said workpiece-contacting element and said probe toward said extended position.

5. A tool as set forth in claim 1, wherein:

said probe extends axially beyond said nosepiece when said probe and workpiece-contacting element assembly is disposed both at said extended and retracted positions so as to always insure proper disposition and location of said nosepiece, and said fastener guided thereby, within said gap defined between said two brick faces.

* * * * *